US008025209B2

(12) United States Patent
Garner

(10) Patent No.: US 8,025,209 B2
(45) Date of Patent: Sep. 27, 2011

(54) STACKING STRENGTH CARTON WITH AN EASY OPENING FEATURE

(75) Inventor: Chester Garner, Richmond, IN (US)

(73) Assignee: Georgia-Pacific Corrugated LLC, Atlanta, GA (US)

( * ) Notice: Subject to any disclaimer, the term of this patent is extended or adjusted under 35 U.S.C. 154(b) by 255 days.

(21) Appl. No.: 12/266,654

(22) Filed: Nov. 7, 2008

(65) Prior Publication Data

US 2009/0121003 A1 May 14, 2009

Related U.S. Application Data

(60) Provisional application No. 60/987,458, filed on Nov. 13, 2007, provisional application No. 60/989,320, filed on Nov. 20, 2007, provisional application No. 61/017,215, filed on Dec. 28, 2007.

(51) Int. Cl.
*B65D 5/02* (2006.01)
*B65D 17/28* (2006.01)

(52) U.S. Cl. ..... 229/241; 229/120.09; 229/120.17; 229/143; 229/146

(58) Field of Classification Search ..... 229/143, 229/146, 190, 223, 234, 241, 120.09, 120.17, 229/144, 915, 918, 919
See application file for complete search history.

(56) References Cited

U.S. PATENT DOCUMENTS

| | | | | |
|---|---|---|---|---|
| 272,327 | A | | 2/1883 | Rogers |
| 981,993 | A | | 1/1911 | Gair et al. |
| 1,892,594 | A | | 12/1932 | Stone |
| 2,082,365 | A | | 6/1937 | Straw et al. |
| 2,114,052 | A | | 4/1938 | Kincade, Jr. |
| 2,300,492 | A | | 11/1942 | Fischer |
| 2,346,488 | A | | 4/1944 | Hoffmaster et al. |
| 2,367,717 | A | | 1/1945 | Davidson |
| 2,547,892 | A | | 4/1951 | Stevens |
| 2,857,090 | A | * | 10/1958 | Fallert ..... 229/154 |
| 2,887,389 | A | * | 5/1959 | Linville ..... 229/146 |
| 2,962,202 | A | | 11/1960 | Hansen |
| 3,164,316 | A | * | 1/1965 | Wurster et al. ..... 229/228 |
| 3,202,339 | A | | 8/1965 | Franklin, Jr. |
| 3,206,099 | A | | 9/1965 | Fanter et al. |
| 3,217,924 | A | | 11/1965 | Chidsey, Jr. |
| 3,265,285 | A | | 8/1966 | Fanter |
| 3,309,005 | A | | 3/1967 | Pilger |
| 3,353,740 | A | * | 11/1967 | Outwater ..... 229/227 |
| 3,447,735 | A | * | 6/1969 | Whitney ..... 229/117.16 |

(Continued)

FOREIGN PATENT DOCUMENTS

DE 1281342 B 10/1968

(Continued)

OTHER PUBLICATIONS

International Search Report and Written Opinion of the International Searching Authority of PCT/US2008/082714, dated Jan. 26, 2009.

*Primary Examiner* — Gary Elkins
(74) *Attorney, Agent, or Firm* — William W. Letson

(57) ABSTRACT

This invention relates to a carton having improved structural integrity and stacking strength. The carton is formed from a paperboard blank so it has reinforced end panels. A tear strip is formed by perforations in the top panel of the carton to provide an easy opening feature.

17 Claims, 7 Drawing Sheets

U.S. PATENT DOCUMENTS

| | | | | | |
|---|---|---|---|---|---|
| 3,552,633 | A | * | 1/1971 | Ketler | 229/143 |
| 3,688,972 | A | | 9/1972 | Mahon | |
| 3,698,548 | A | * | 10/1972 | Stenzel et al. | 229/146 |
| 3,747,801 | A | | 7/1973 | Graser | |
| 3,826,421 | A | | 7/1974 | Morse et al. | |
| 3,883,067 | A | * | 5/1975 | McGlynn et al. | 229/177 |
| 4,029,207 | A | | 6/1977 | Gordon | |
| 4,056,223 | A | | 11/1977 | Williams | |
| 4,084,693 | A | | 4/1978 | Culpepper | |
| 4,256,226 | A | | 3/1981 | Stone | |
| 4,267,959 | A | * | 5/1981 | Gilbert | 229/117.14 |
| 4,283,001 | A | | 8/1981 | Meyers | |
| 4,702,407 | A | | 10/1987 | Lisiecki | |
| 4,771,939 | A | | 9/1988 | Wilkins | |
| 4,850,527 | A | | 7/1989 | Church et al. | |
| D337,270 | S | | 7/1993 | Brockman | |
| 5,323,957 | A | | 6/1994 | Roosa | |
| 5,400,955 | A | | 3/1995 | Coalier et al. | |
| 5,427,242 | A | | 6/1995 | Oliff et al. | |
| 5,474,232 | A | | 12/1995 | Ljungstrom et al. | |
| 5,755,377 | A | | 5/1998 | Durand | |
| 5,957,294 | A | | 9/1999 | Kanter | |
| 6,098,874 | A | | 8/2000 | Tokarski | |
| 6,834,793 | B2 | * | 12/2004 | Sutherland | 229/227 |
| 6,866,186 | B2 | | 3/2005 | Fogle et al. | |
| 7,201,714 | B2 | * | 4/2007 | Zoeckler et al. | 493/89 |
| 7,766,219 | B2 | | 8/2010 | Gomes et al. | |
| 2003/0234285 | A1 | | 12/2003 | Bates et al. | |
| 2005/0189405 | A1 | | 9/2005 | Gomes et al. | |
| 2007/0000986 | A1 | | 1/2007 | McClure | |
| 2007/0063005 | A1 | * | 3/2007 | Gomes et al. | 229/120.09 |
| 2009/0095799 | A1 | | 4/2009 | Garner | |
| 2009/0121006 | A1 | | 5/2009 | Gasior | |

FOREIGN PATENT DOCUMENTS

| | | | |
|---|---|---|---|
| EP | 0468860 | A1 | 1/1992 |
| GB | 2419345 | A | 4/2006 |
| GB | 2436830 | A | 10/2007 |
| WO | 01/66423 | A1 | 9/2001 |
| WO | 2006/026767 | A2 | 3/2006 |

* cited by examiner

STACKING STRENGTH CARTON WITH AN EASY OPENING FEATURE

CROSS-REFERENCE TO RELATED APPLICATIONS

This application claims the benefit of Provisional Application Ser. No. 60/987,458 filed Nov. 13, 2007, Provisional Application Ser. No. 60/989,320 filed Nov. 20, 2007 and Provisional Application Ser. No. 61/017,215 filed Dec. 28, 2007. The disclosures of the foregoing provisional patent applications are hereby incorporated herein by reference in their entireties.

BACKGROUND OF THE INVENTION

The invention relates to packaging for shipping and storing products. More particularly, the invention relates to a paperboard carton that can be used to package, ship and store a variety of products, such as consumer products and, more particularly, beverage containers. Such beverage containers may come in various configurations such as cylindrical cans, bottles of various configurations or flexible pouches having a substantially trapezoidal configuration.

For many years, beverage companies, such as soft drink, fruit juice and beer companies have packaged their products in light weight paperboard cartons and shipped such products to a retail outlet or some other location where consumers can purchase the products. There are many different types of cartons that can be used for packaging and shipping products from the manufacturer to the retailer. However, many of these cartons tend to be large and are designed to hold large numbers of products. Such cartons are suitable for "warehouse" type operations but are difficult for the consumer to store and use when the consumer needs smaller quantities for typical household activities.

Products can be packaged in smaller cartons containing quantities of product that a consumer would typically want to purchase for use in a relatively short period of time, such as ten or a dozen individual items. It is desirable for these smaller quantities of product to be packaged in smaller cartons that can be displayed for sale to the consumer at a typical retail outlet. In order to maximize the use of valuable floor space at the retail outlet, such smaller cartons may be stacked on top of each other to minimize the footprint left by the cartons and to provide an attractive display to entice the consumer to buy the product. Unfortunately, such stacking can result in damage to the carton causing the consumer to assume that the individual products packaged within the carton are damaged as well. This is bad for the retailer because such perceived damaged goods are more difficult to sell and thus can result in lower profits.

Another desirable attribute for such paperboard cartons is an easy opening feature so that the cartons can be easily opened. This facilitates easy access by the consumer to the products, such as beverage containers, contained therein. These paperboard cartons with easy opening features appeal to consumers because such cartons provide an easy way for the consumer to transport a number of products, such as beverage containers, therein from the retail outlet to the consumer's home. Moreover, the dispensing openings allow the paperboard cartons to also be stored in an easily accessible location in the consumer's home, such as the refrigerator, to allow neat storage of the product therein. Although some paperboard cartons having dispensing openings therein are currently available and generally work for their intended purposes they could be improved. For example, some of these cartons are in fact difficult to open. In addition, some of the cartons having such dispensing openings can have compromised structural integrity because of such openings.

Therefore, there is a need to provide a carton with improved stacking strength and an easy opening feature that may be used to package and ship individual items from the manufacturer to a retail outlet and that can also be used in homes and other consumer locations.

BRIEF SUMMARY OF THE INVENTION

A paperboard carton is provided having a top, a bottom, two side panels and two end walls. A tear strip is formed by perforations in the top panel that allows the consumer to easily tear the top panel in half and thereafter open the carton like a suitcase about a bottom fold line. The open suitcase type configuration allows access to all the products contained in the carton. The material used to form the paperboard carton can be any standard paperboard material such as corrugated paperboard that is typically used for packaging or shipping containers. This material provides enough rigidity to the carton to allow it to maintain its shape and retain the product therein. In accordance with this invention, the end walls are reinforced to provide improved stacking strength for the carton.

A blank for forming the paperboard carton is also provided. The blank includes an adhesive panel, a first side panel, a bottom panel, a second side panel and a top panel. Longitudinally extending perforations are located in the top panel of the blank to form a tear strip that allows the consumer to easily tear the top panel in half when the blank is formed into the paperboard carton. A longitudinally extending fold line is formed in the bottom panel. End flaps adjoin the first and second side panels. Preferably, the end flaps are formed from multiple sections that are folded over onto each other to provide a multi-wall configuration that results in reinforced end walls. The end flaps are generally rectangular in shape and each section of the end flaps has a height that is approximately half the width of the bottom panel. In addition, other end flaps adjoin the adhesive panel, the bottom panel and the top panel. The end flaps for the top panel extend only across about half of the width of the top panel. These end flaps for the top panel and the perforations on the top panel, along with the fold line along the bottom panel, are designed to facilitate opening the carton in half like a suitcase.

BRIEF DESCRIPTION OF THE DRAWINGS

The various objects, advantages and novel features of the present invention will be best understood by reference to the detailed description of the preferred embodiments which follows, when read in conjunction with the accompanying drawings, in which.

DETAILED DESCRIPTION OF THE INVENTION

Figure 1:
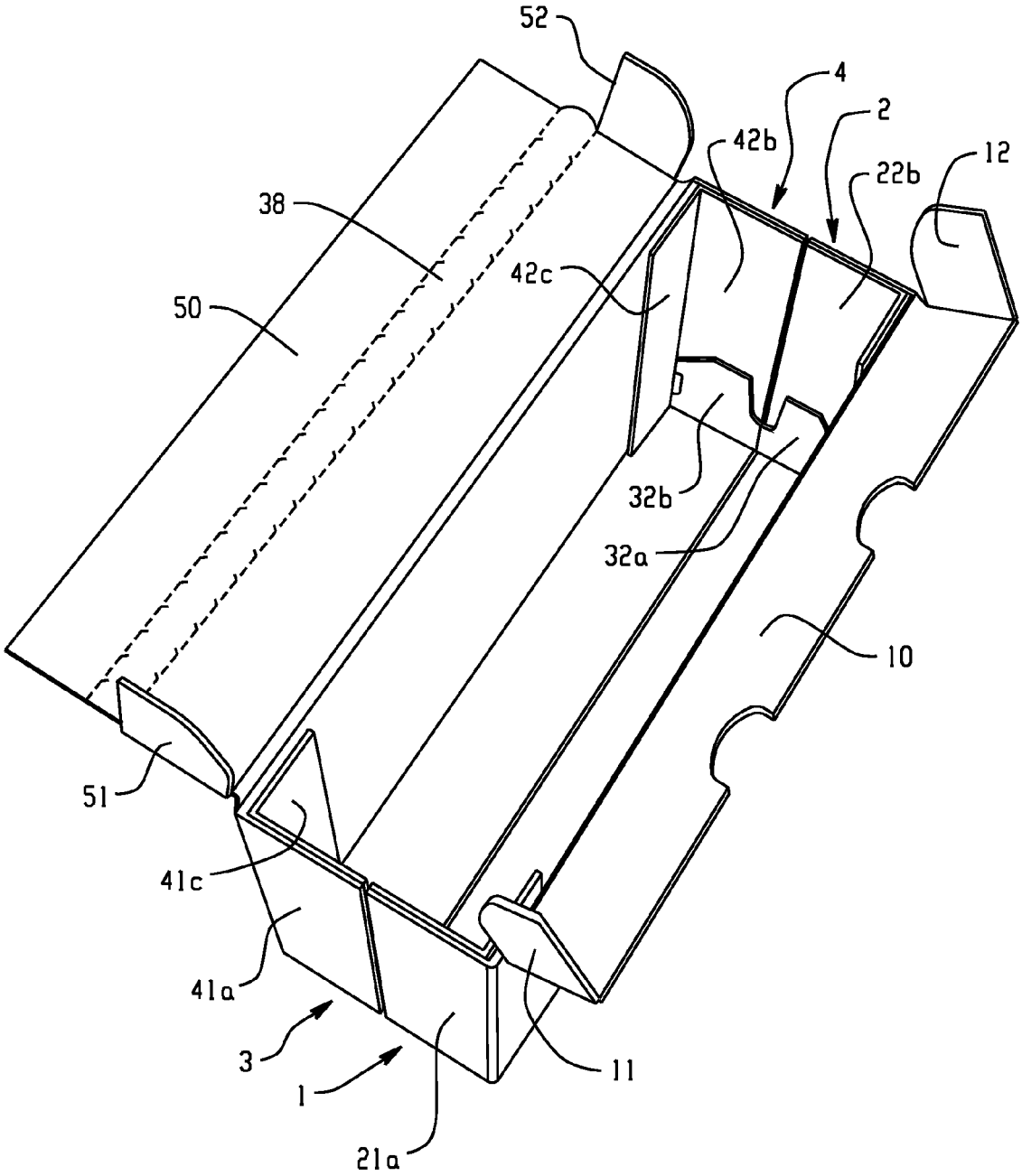
FIG. 1 is a top perspective view of the paperboard carton of the present invention, with the top open to show the construction of the carton.

In the figures, the same elements are denoted by the same reference numerals even though they are depicted in different figures. As used herein, the term "top" refers to a location on the carton or blank of this invention, as the case may be, along the upper surface thereof as seen in the orientation shown in the figures. As used herein, the term "bottom" refers to a location on the carton or blank of this invention, as the case may be, along the lower surface thereof as seen in the orientation shown in the figures. As used herein, the term "end" when used in reference to a position on the carton of this invention refers to either the right most or left most side of the carton as seen in the orientation of the carton shown in the carton figures. As used herein, the term "right" refers to a location on the carton or blank of this invention, as the case may be, along the right side thereof as seen in the orientation shown in the figures. As used herein, the term "left" refers to a location on the carton or blank of this invention, as the case may be, along the left side thereof as seen in the orientation shown in the figures. As used herein, the term "upper" refers to a location on the carton or blank of this invention, as the case may be, along the upper or top portion thereof as seen in the orientation shown in the figures. As used herein, the term "lower" refers to a location on the carton or blank of this invention, as the case may be, along the lower or bottom portion thereof as seen in the orientation shown in the figures.

Figure 2:
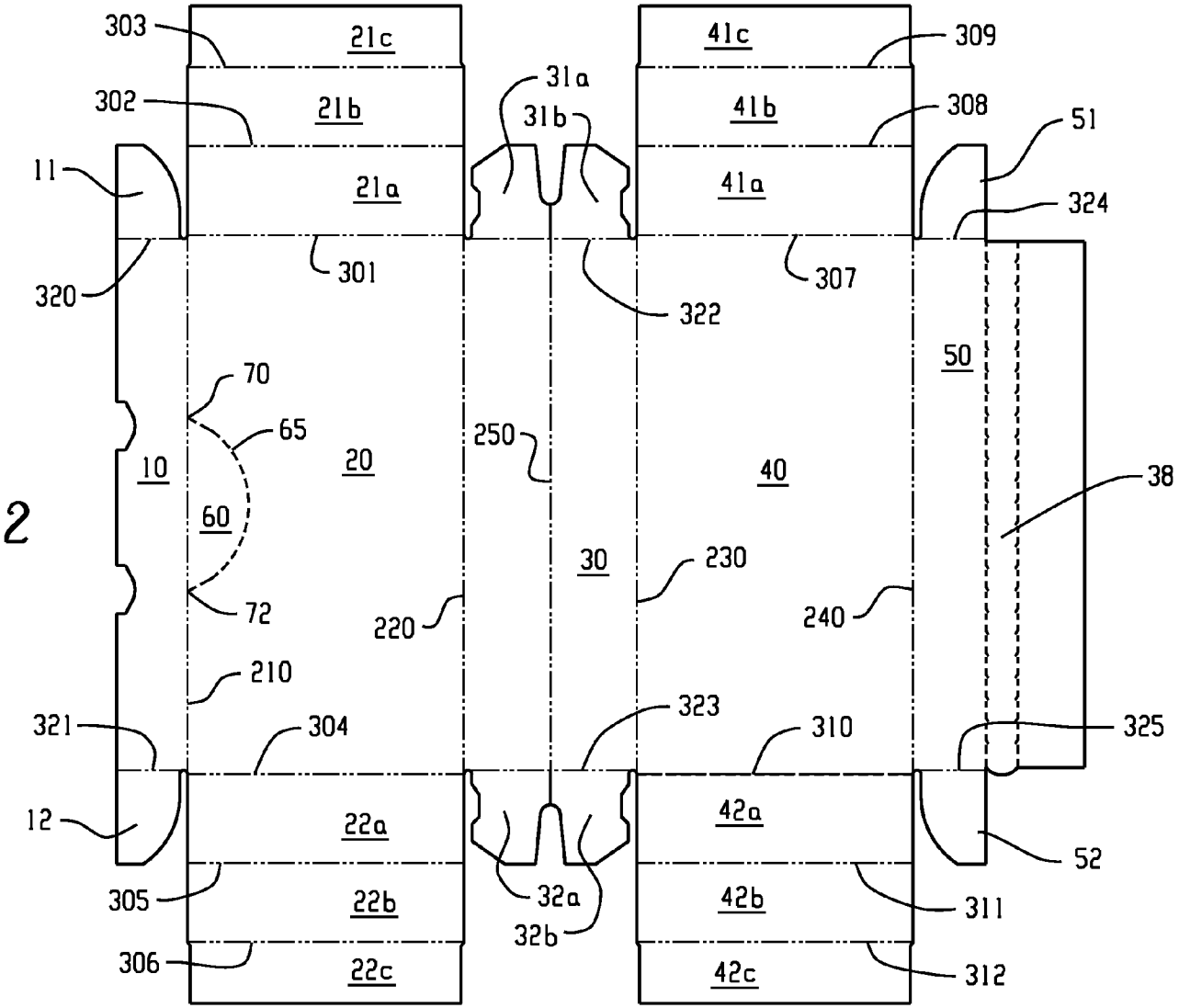
FIG. 2 is a plan view of the blank used to make the paperboard carton of the present invention.
Figure 3:
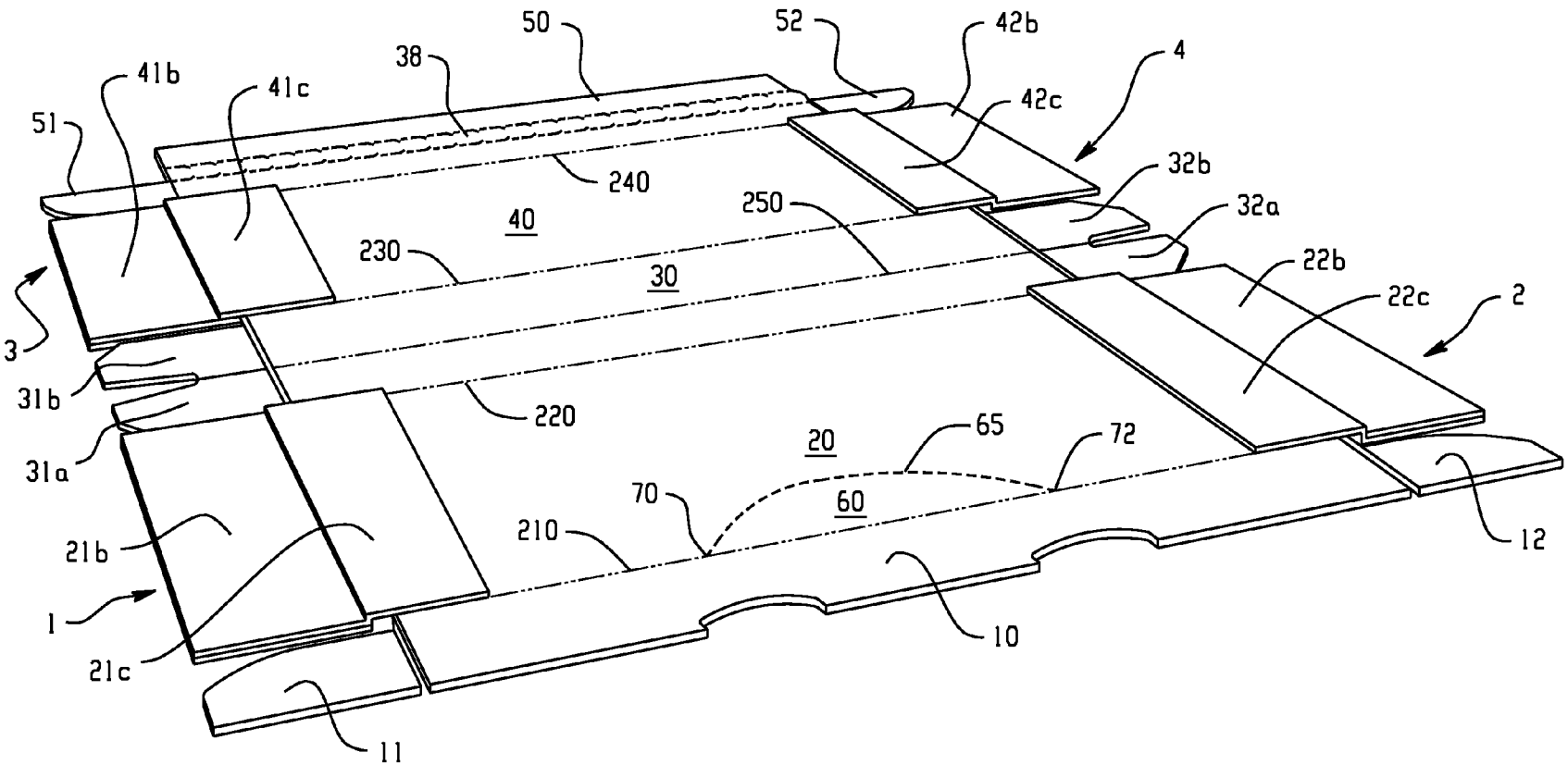
FIG. 3 is a top perspective view of the blank used to make the paperboard carton of the present invention with the side panel end flaps folded over and adjoining the side panels to which they are attached.

As shown in FIGS. 1, 2 and 3, the carton 100 of the present invention has a generally rectangular footprint and includes folded end panels 1, 2, 3 and 4 formed from side panel end flaps 21*a*, 21*b*, 21*c*, 22*a*, 22*b*, 22*c*, 41*a*, 41*b*, 41*c*, 42*a*, 42*b* and 42*c*. Folded end panels 1, 2, 3 and 4 provide added stacking strength to carton 100 and are formed by folding over side panel end flaps 21*a*, 21*b*, 21*c*, 22*a*, 22*b*, 22*c*, 41*a*, 41*b*, 41*c*, 42*a*, 42*b* and 42*c*, as more fully described below. In this orientation, first side panel first end flap 21*a* and first side panel second end flap 21*b* are in face to face relationship to each other, with first side panel third end flap 21*c* adhered to first side panel 20. First side panel fourth end flap 22*a* and first side panel fifth end flap 22*b* are in face to face relationship to each other, with first side panel sixth end flap 22*c* adhered to first side panel 20. Similarly, second side panel first end flap 41*a* and second side panel second end flap 41*b* are in face to face relationship to each other, with second side panel third end flap 41*c* adhered to second side panel 40. Second side panel fourth end flap 42*a* and second side panel fifth end flap 42*b* are in face to face relationship to each other, with second side panel sixth end flap 42*c* adhered to second side panel 40. This provides added material around the corners of carton 100 and improves the structural integrity of carton 100. With this added structural integrity, a lighter weight paperboard material can be used to fabricate carton 100 without compromising the overall strength of the assembled carton. In other words, added paperboard material is located only in the areas of carton 100 where it is needed, i.e. the corners, to maintain the structural integrity of carton 100.

A top panel 50 includes a tear strip 38 that extends longitudinally substantially along the middle of the top panel 50. More specifically, the tear strip 38 extends between the four end panels 1, 2, 3 and 4 forming the two end walls. The tear strip 38 allows top panel 50 to be easily separated in half and thus provides the consumer with a mechanism to easily open the carton 100 like a suitcase.

First side panel 20 includes a handle 60 defined by a semi-circular cut-out 65 with ends 70, 72 that are adjacent to a first vertical fold line 210. Semi-circular cut-out 65 is preferably formed as a perforation line.

A paperboard blank 200 that can be used to make carton 100 is shown in FIG. 2. Blank 200 includes an adhesive panel 10. In addition, blank 200 includes four main panels, a first side panel 20, a bottom panel 30, a second side panel 40 and a top panel 50. Adhesive panel 10 is connected along its right side to the left side of first side panel 20 along first vertical fold line 210. First side panel 20 is connected along its right side to the left side of bottom panel 30 along a second vertical fold line 220. Bottom panel 30 is connected along its right side to the left side of second side panel 40 along a third vertical fold line 230. Second side panel 40 is connected along its right side to the left side of top panel 50 along a fourth vertical fold line 240. A fifth vertical fold line 250 may also be included and splits bottom panel 30 in half.

A first side panel first end flap 21*a* extends above first side panel 20 above a first generally horizontal fold line 301. A first side panel second end flap 21*b* extends above first side panel first end flap 21*a* above a second generally horizontal fold line 302. A first side panel third end flap 21*c* extends above first side panel second end flap 21*b* above a third generally horizontal fold line 303. A first side panel fourth end flap 22*a* extends below first side panel 20 below a fourth generally horizontal fold line 304. A first side panel fifth end flap 22*b* extends below first side panel fourth end flap 22*a* below a fifth generally horizontal fold line 305. A first side panel sixth end flap 22*c* extends below first side panel fifth end flap 22*b* below a sixth generally horizontal fold line 306. A second side panel first end flap 41*a* extends above second side panel 40 above a seventh generally horizontal fold line 307. A second side panel second end flap 41*b* extends above second side panel first end flap 41*a* above an eighth generally horizontal fold line 308. A second side panel third end flap 41*c* extends above second side panel second end flap 41*b* above a ninth generally horizontal fold line 309. A second side panel fourth end flap 42*a* extends below second side panel 40 below a tenth generally horizontal fold line 310. A second side panel fifth end flap 42*b* extends below second side panel fourth end flap 42*a* below an eleventh generally horizontal fold line 311. A second side panel sixth end flap 42*c* extends below second side panel fifth end flap 42*b* below a twelfth generally horizontal fold line 312.

An adhesive panel first end flap 11 adjoins adhesive panel 10 above generally horizontal fold line 320. An adhesive panel second end flap 12 adjoins adhesive panel 10 below generally horizontal fold line 321. Bottom panel first end flap 31*a* and bottom panel second end flap 31*b* adjoin bottom panel 30 above generally horizontal fold line 322. Bottom panel third end flap 32*a* and bottom panel fourth end flap 32*b* adjoin bottom panel 30 below generally horizontal fold line 323. A top panel first end flap 51 adjoins top panel 50 above generally horizontal fold line 324. Preferably top panel first end flap 51 extends along about one half of the width of top panel 50 but does not extend across either perforation line defining tear strip 38. A top panel second end flap 52 adjoins top panel 50 below generally horizontal fold line 325. Preferably top panel second end flap 52 extends along about one half of the width of top panel 50 but does not extend across either perforation line defining tear strip 38.

All of the fold lines formed in blank 100 are formed by crushing the paperboard material along the line to be folded to facilitate bending of the paperboard material to form the various panels and flaps.

All perforations in the paperboard blank of this disclosure preferably are formed by scoring the paperboard so it is cut about 50% into the outer side of the paperboard material. This 50% cut is a continuous cut that extends from the surface of the material down to a depth that is about one half of the thickness of the material. The 50% cut assures a clean tear at the surface that leaves a relatively pleasing appearance, particularly when the paperboard blank is printed.

To assemble carton 100, blank 200 is first folded by bending the paperboard material along second generally horizontal fold line 302, fifth generally horizontal fold line 305, eighth generally horizontal fold line 308 and eleventh generally horizontal fold line 311 so that first side panel second end flap 21*b* is folded over and adjoins first side panel first end flap 21*a* in face to face relationship, first side panel fifth end flap 22*b* is folded over and adjoins first side panel fourth end flap 22*a* in face to face relationship, second side panel second end flap 41*b* is folded over and adjoins second side panel first end flap 41*a* in face to face relationship and second side panel fifth end flap 42*b* is folded over and adjoins second side panel fourth end flap 42*a* in face to face relationship. See FIG. 3. In this configuration, first horizontal fold line 301 and third generally horizontal fold line 303 are generally aligned to form a first folded end panel 1, fourth generally horizontal fold line 304 and sixth generally horizontal fold line 306 are generally aligned to form a second folded end panel 2, seventh generally horizontal fold line 307 and ninth generally fold line 309 are generally aligned to form a third folded end panel 3 and tenth generally horizontal fold line 310 and twelfth generally horizontal fold line 312 are generally aligned to form a fourth folded end panel 4. In addition, first side panel third end flap 21*c* and first side panel sixth end flap 22*c* are adhered to first side panel 20. Similarly, second side panel third end flap 41*c* and second side panel sixth end flap 42*c* are adhered to second side panel 40. See FIG. 3.

Figure 4:
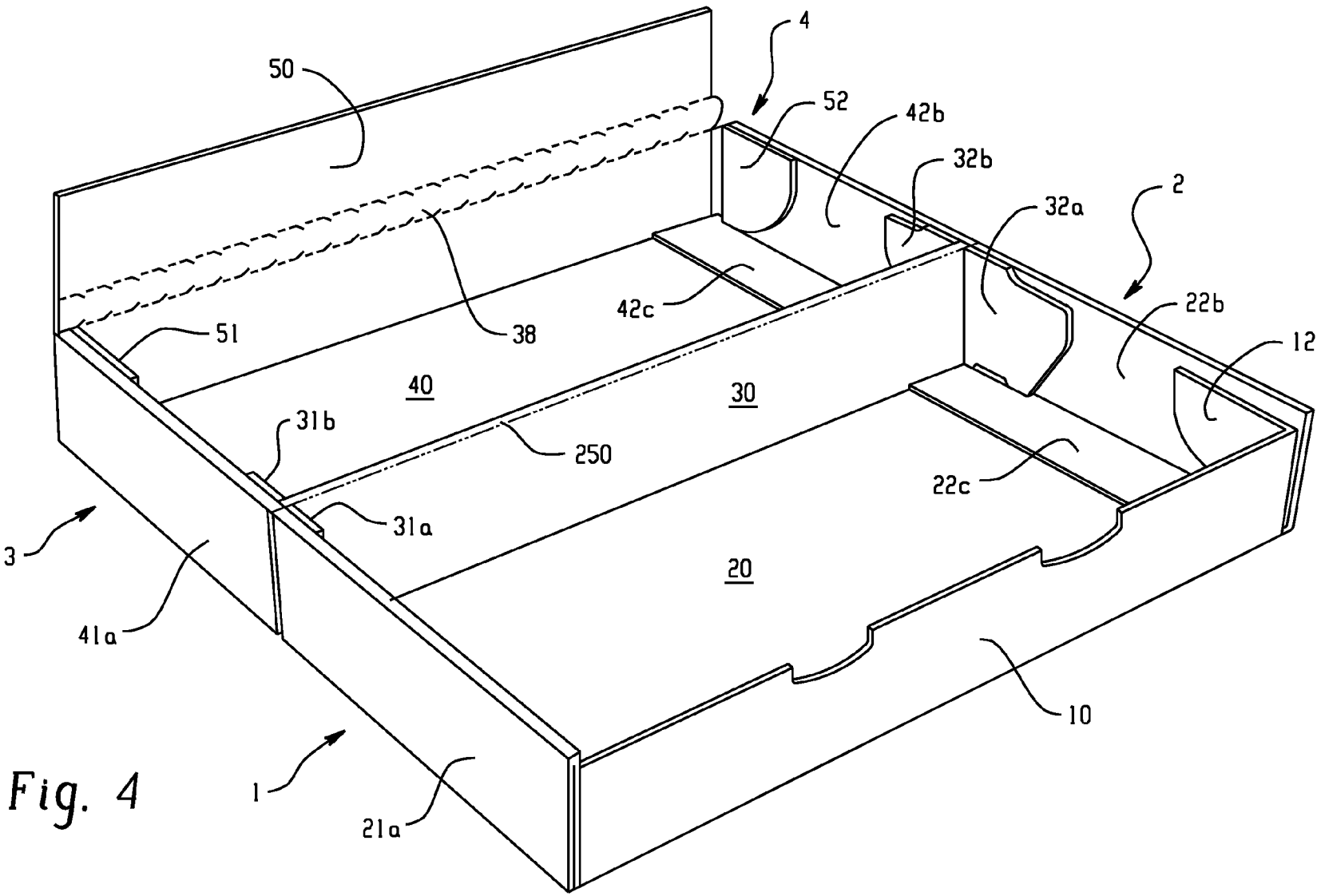
FIG. 4 is a top perspective view of the blank used to make the paperboard carton of the present invention with the side panel end flaps, the adhesive panel, the top panel and the bottom panel all folded up so that the partially erected carton has an open suitcase like configuration.
Figure 5:
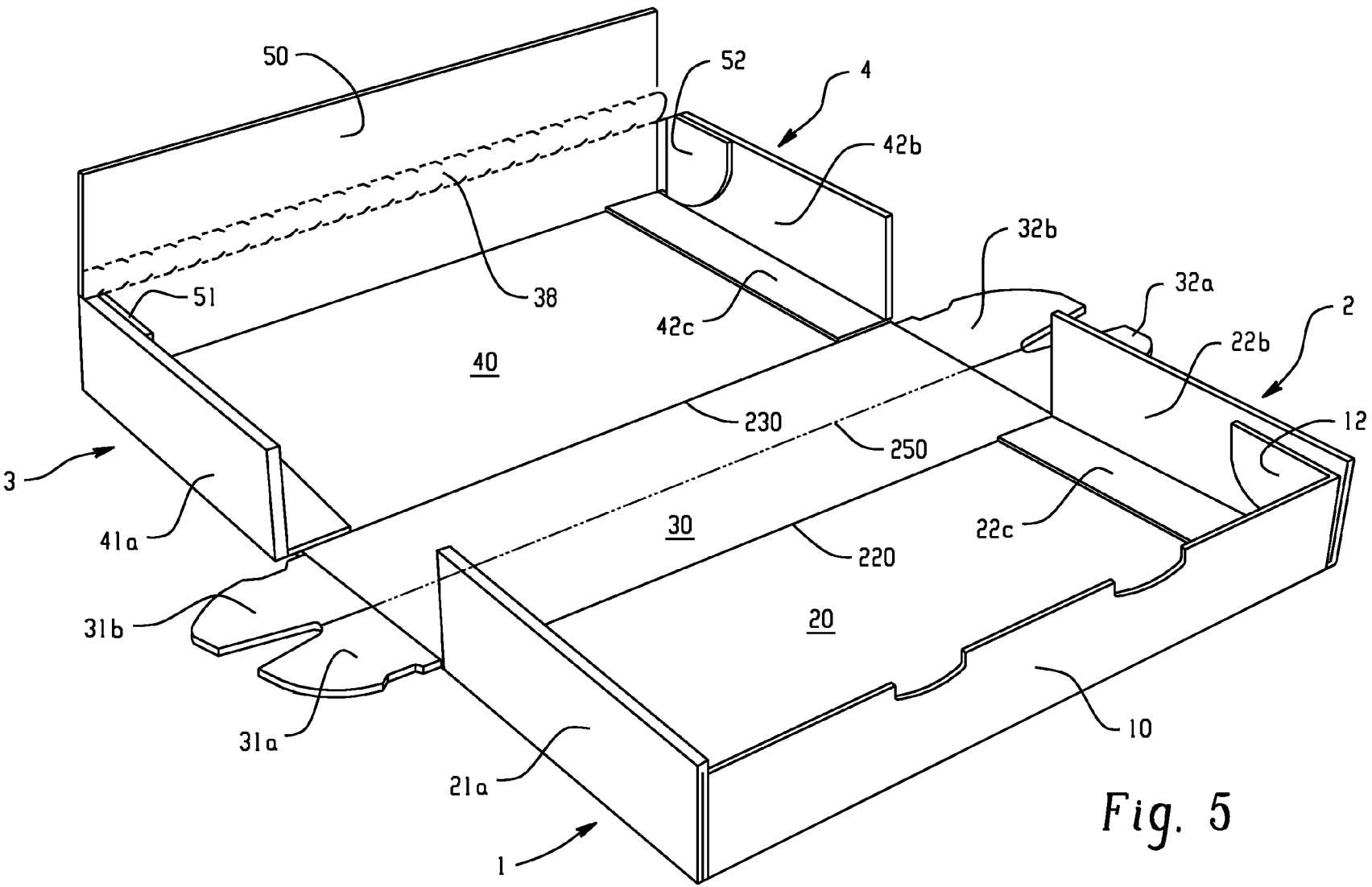
FIG. 5 is a top perspective view of the blank used to make the paperboard carton of the present invention with the side panel end flaps, the adhesive panel, and the top panel all folded up so that the partially erected carton has a tray like configuration.

Blank 200 can then be folded by bending the paperboard material along first vertical fold line 210 and fourth vertical fold line 240. This allows adhesive panel 10 and top panel 50 to be folded 90 degrees such that adhesive panel 10 is generally perpendicular to first side panel 20 and top panel 50 is generally perpendicular to second side panel 40 and adhesive panel 10 and top panel 50 extend in the same direction. Blank 200 can then be folded along first horizontal fold line 301, third horizontal fold line 303, fourth horizontal fold line 304, sixth horizontal fold line 306, seventh horizontal fold line 307, ninth horizontal fold line 309, tenth horizontal fold line 310 and twelfth horizontal fold line 312 such that first folded end panel 1 and second folded end panel 2 are generally perpendicular to first side panel 20 and extend in the same direction and third folded end panel 3 and fourth folded end panel 4 are generally perpendicular to second side panel 40 and extend in the same direction. Adhesive panel first end flap 11 is folded so it is generally perpendicular to adhesive panel 10 and can be adhered to first folded end panel 1. Adhesive panel second end flap 12 is folded so it is generally perpendicular to adhesive panel 10 and can be adhered to second folded end panel 2. Top panel first end flap 51 is folded so it is generally perpendicular to top panel 50 and can be adhered to third folded end panel 3. Top panel second end flap 52 is folded so it is generally perpendicular to top panel 50 and can be adhered to fourth folded end panel 4. See FIGS. 4 and 5. Note that adhesive panel first end flap 11 cannot be seen in those figures because of the view in those figures. However it would be located in the bottom left portion of the partially assembled carton along the inside right portion of first folded end panel 1.

In one embodiment, bottom panel 30 can be folded in half, 180 degrees along fifth vertical fold line 250 so that each half of bottom panel 30 is abutting one another in face to face relationship. See FIG. 4. In addition, bottom panel first end flap 31*a* is folded so it is perpendicular to bottom panel 30 and adjoins first folded end panel 1. Bottom panel second end flap 31*b* is folded so it is perpendicular to bottom panel 30 and adjoins third folded end panel 3. Bottom panel third end flap 32*a* is folded so it is perpendicular to bottom panel 30 and adjoins second folded end panel 2. Bottom panel fourth end flap 32*b* is folded so it is perpendicular to bottom panel 30 and adjoins fourth folded end panel 4. In this open suitcase type orientation, product can be loaded into the partially erected carton before it is folded up like closing a suitcase. When this is done, top panel 50 overlaps adhesive panel 10, or vice versa, so that top panel 50 and adhesive panel 10 can be adhered together to fully erect carton 100.

In another embodiment, instead of folding bottom panel 30 in half, first side panel 20 can be folded along second vertical fold line 220 so first side panel 20 is perpendicular to bottom panel 30 and second side panel 40 can be folded along third vertical fold line 230 so second side panel 40 is perpendicular to bottom panel 30 with first side panel 20 and second side panel 40 extending in the same direction. Compare FIG. 1 with FIG. 5. In this configuration, bottom panel first end flap 31*a* can be adhered to first folded end panel 1, bottom panel second end flap 31*b* can be adhered to third folded end panel 3, bottom panel third end flap 32*a* can be adhered to second folded end panel 2 and bottom panel fourth end flap 32*b* can be adhered to fourth folded end panel 4. With carton 100 in this configuration, product can be loaded through the top of carton 100. Thereafter, adhesive panel 10 is folded over so that adhesive panel first end flap 11 and adhesive panel second end flap 12 abut and are adhered to first folded end panel 1 and second folded end panel 2 respectively. Similarly, top panel 50 is folded over so that top panel first end flap 51 and top panel second end flap 52 abut and are adhered to third folded panel 3 and fourth folded end panel 4 respectively. In addition, top panel 50 can be adhered to adhesive panel 10.

Figure 6:
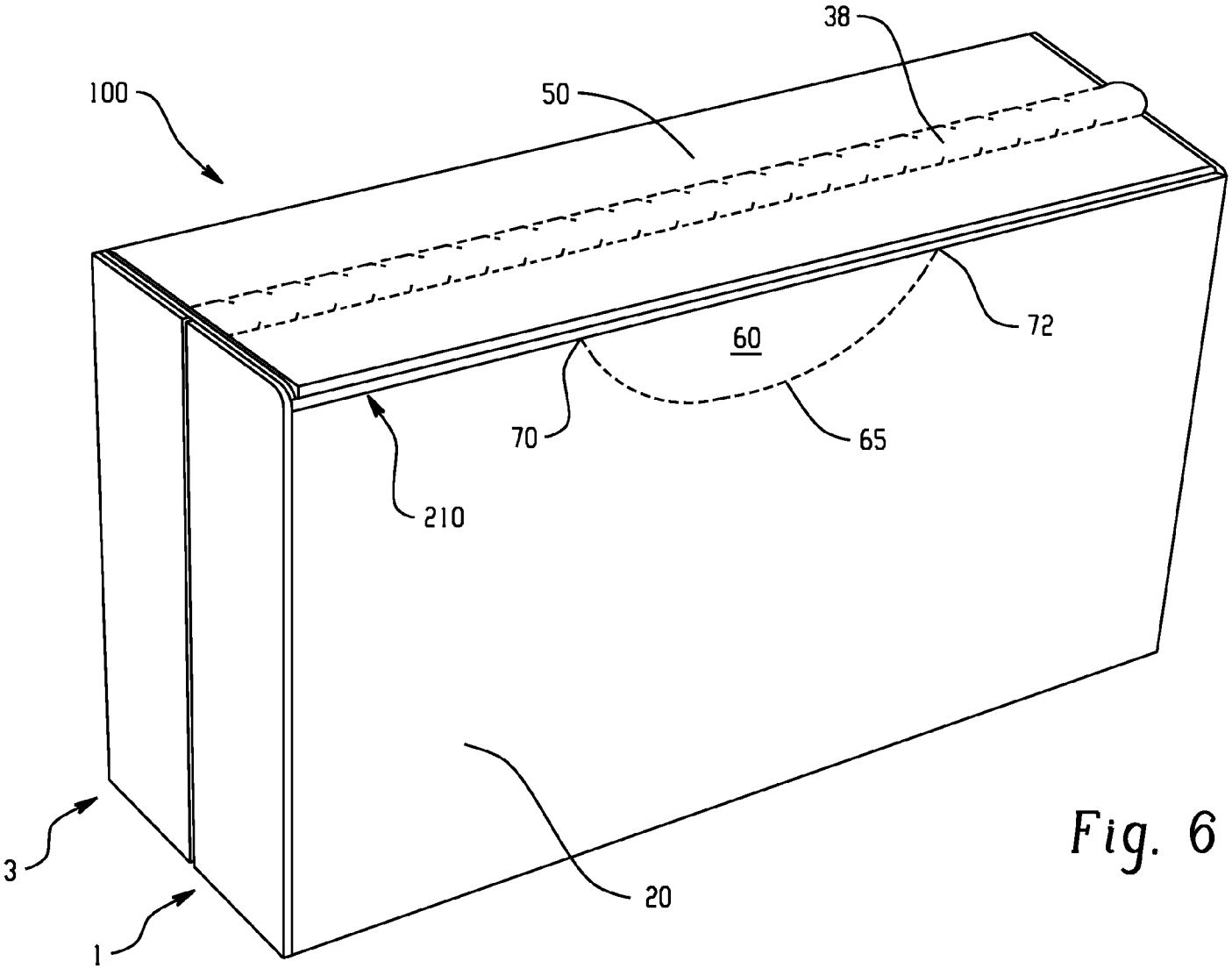
FIG. 6 is a top perspective view of the paperboard carton of the present invention that has been completely erected.
Figure 7:
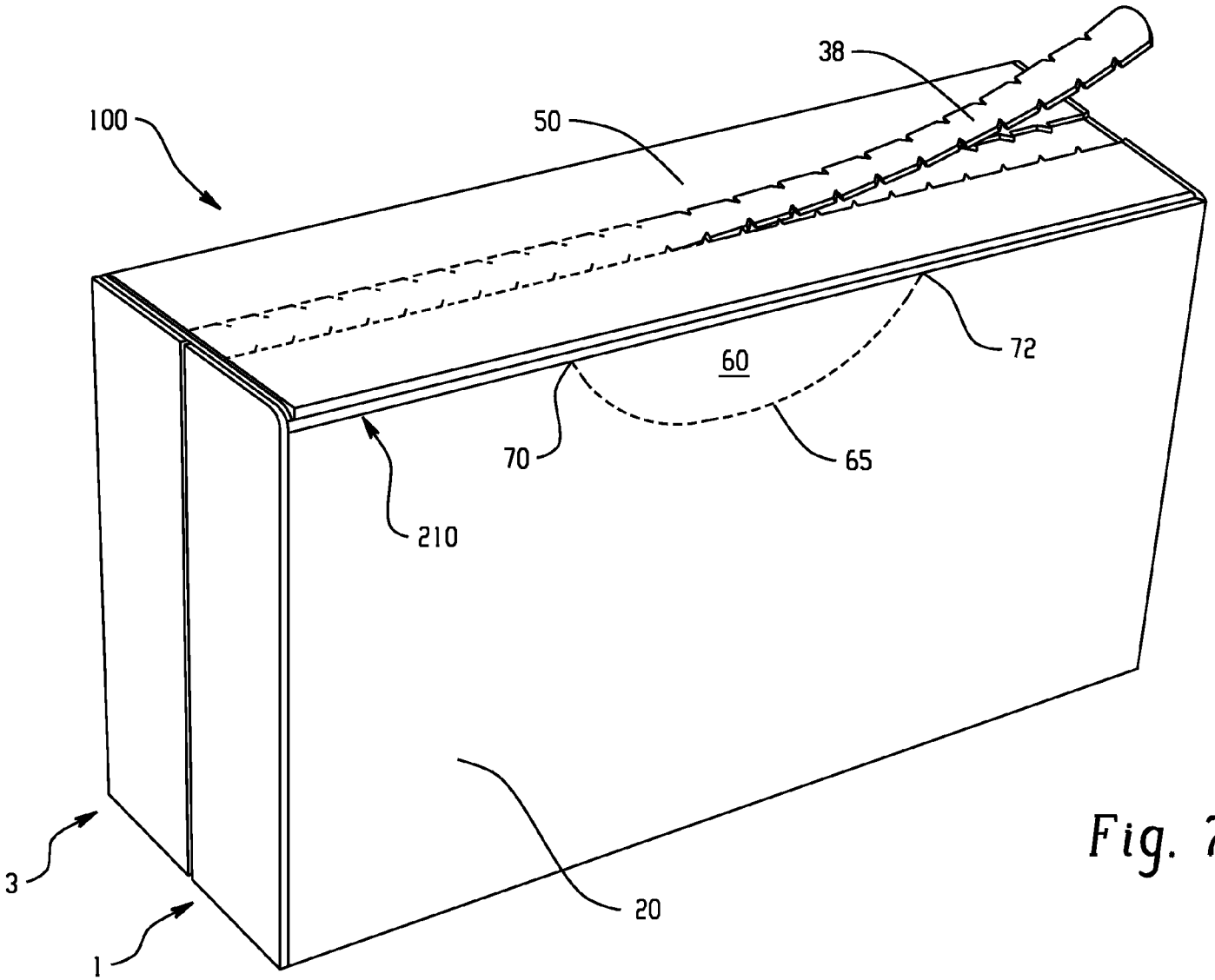
FIG. 7 is a top perspective view of the paperboard carton of the present invention with the tear strip of the easy opening feature partially torn away.

FIG. 6 is a perspective view of the paperboard carton of the present invention that has been completely erected. Tear strip 38 allows top panel 50 to be easily separated in half and thus provides the consumer with a mechanism to easily open the carton 100 like a suitcase. FIG. 7 is a perspective view of the paperboard carton of the present invention where tear strip 38 has been partially torn away from top panel 50 to facilitate opening of the carton. First side panel 20 includes a handle 60 defined by a semi-circular cut-out 65 with ends 70, 72 that are adjacent to fold line 210.

When it is desired by the consumer to open carton 100, tear strip 38 can be torn off of top panel 50. This allows the consumer to fold open carton 100 along fold line 250 in the bottom panel 30 since the half of top panel 50 that does not include end flaps 51 or 52 is no longer connected to adhesive panel 10 or the remaining portion of top panel 50.

It should be noted that any panel or flap that is described as adhered to another panel or flap may be glued by any standard adhesive, or stapled or otherwise fastened by conventional means.

The present invention has been described with reference to exemplary embodiments thereof. It will be readily apparent, however, to those skilled in the art that it is possible to embody the invention in specific forms other than those of the exemplary embodiments described above. This may be done without departing from the spirit of the invention. The exemplary embodiments are merely illustrative and should not be considered restrictive in any way.

The invention claimed is:

1. A carton comprising:

a top panel;

a bottom panel;

a first side panel and a second side panel each adjoining the top panel and the bottom panel;

a first end wall and a second end wall each adjoining the first side panel, the second side panel, the top panel and the bottom panel;

wherein the first end wall is formed from a first side panel first end flap in a face to face relationship with a first side panel second end flap, with a first side panel third end flap adhered to the first side panel, and a second side panel first end flap in a face to face relationship with a second side panel second end flap, with a second side panel third end flap adhered to the second side panel;

wherein the first side panel is edgewise conjoined at a first fold line with the first side panel first end flap, the first side panel first end flap is edgewise conjoined at a second fold line with the first side panel second end flap, and the first side panel second end flap is edgewise conjoined at a third fold line with the first side panel third end flap;

wherein the second side panel is edgewise conjoined at a fourth fold line with the second side panel first end flap, the second side panel first end flap is edgewise conjoined at a fifth fold line with the second side panel second end flap, and the second side panel second end flap is edgewise conjoined at a sixth fold line with the second side panel third end flap;

wherein the first side panel first end flap and the second side panel first end flap form an exterior surface of the carton, and the second fold line abuts the fifth fold line;

wherein the second end wall is formed from a first side panel fourth end flap in a face to face relationship with a first side panel fifth end flap, with a first side panel sixth end flap adhered to the first side panel, and a second side panel fourth end flap in a face to face relationship with a second side panel fifth end flap, with a second side panel sixth end flap adhered to the second side panel;

wherein the first side panel is edgewise conjoined at a seventh fold line with the first side panel fourth end flap, the first side panel fourth end flap is edgewise conjoined at an eighth fold line with the first side panel fifth end flap, and the first side panel fifth end flap is edgewise conjoined at a ninth fold line with the first side panel sixth end flap;

wherein the second side panel is edgewise conjoined at a tenth fold line with the second side panel fourth end flap, the second side panel fourth end flap is edgewise conjoined at an eleventh fold line with the second side panel fifth end flap, and the second side panel fifth end flap is edgewise conjoined at a twelfth fold line with the second side panel sixth end flap;

wherein the first side panel fourth end flap and the second side panel fourth end flap form an exterior surface of the carton, and the eighth fold line abuts the eleventh fold line; and wherein the first side panel comprises a handle defined by a perforation line in the first side panel adjacent to a fold line between the top panel and the first side panel.

2. The carton of claim 1, wherein the top panel includes a tear strip that extends between the first end wall and the second end wall.

3. The carton of claim 2, wherein the bottom panel includes a substantially longitudinally extending fold line about which the carton may be opened upon removal of the tear strip.

4. The carton of claim 3, wherein the handle is further defined by a semi-circular perforation line in the first side panel.

5. The carton of claim 1 further comprising an adhesive panel first end flap adhered to the first side panel second end flap and an adhesive panel second end flap adhered to the first side panel fifth end flap.

6. The carton of claim 5 further comprising a top panel first end flap adhered to the second side panel second end flap and a top panel second end flap adhered to the second side panel fifth end flap.

7. The carton of claim 6 wherein the top panel includes a tear strip that extends between the first end wall and the second end wall.

8. The carton of claim 7 wherein the bottom panel includes a substantially longitudinally extending fold line about which the carton may be opened upon removal of the tear strip.

9. The carton of claim 8 wherein the first side panel includes a handle defined by a semi-circular cut-out adjacent to a fold line between the top panel and the first side panel.

10. A paperboard blank comprising:

an adhesive panel;

a first side panel adjoining the adhesive panel;

a bottom panel adjoining the first side panel;

a second side panel adjoining the bottom panel;

a top panel adjoining the second side panel;

a first side panel top end flap formed from a first side panel first end flap, a first side panel second end flap, and a first side panel third end flap, wherein the first side panel is edgewise conjoined at a first fold line with the first side panel first end flap, the first side panel first end flap is edgewise conjoined at a second fold line with the first side panel second end flap, and the first side panel second end flap is edgewise conjoined at a third fold line with the first side panel third end flap;

a second side panel top end flap formed from a second side panel first end flap, a second side panel second end flap, and a second side panel third end flap, wherein the second side panel is edgewise conjoined at a fourth fold line with the second side panel first end flap, the second side panel first end flap is edgewise conjoined at a fifth fold line with the second side panel second end flap, and the second side panel second end flap is edgewise conjoined at a sixth fold line with the second side panel third end flap;

wherein the blank is foldable such that the first side panel first end flap and the second side panel first end flap would be disposed to form an exterior surface of a carton, and the second fold line and the fifth fold line would be disposed to abut each other;

a first side panel bottom end flap formed from a first side panel fourth end flap, a first side panel fifth end flap, and a first side panel sixth end flap, wherein the first side panel is edgewise conjoined at a seventh fold line with the first side panel fourth end flap, the first side panel fourth end flap is edgewise conjoined at an eighth fold line with the first side panel fifth end flap, and the first side panel fifth end flap is edgewise conjoined at a ninth fold line with the first side panel sixth end flap;

a second side panel bottom end flap formed from a second side panel fourth end flap, a second side panel fifth end flap, and a second side panel sixth end flap, wherein the second side panel is edgewise conjoined at a tenth fold line with the second side panel fourth end flap, the second side panel fourth end flap is edgewise conjoined at an eleventh fold line with the second side panel fifth end flap, and the second side panel fifth end flap is edgewise conjoined at a twelfth fold line with the second side panel sixth end flap; and wherein the blank is foldable such that the first side panel fourth end flap and the second side panel fourth end flap would be disposed to form an exterior surface of a carton, and the eighth fold line and the eleventh fold line would be disposed to abut each other.

11. The paperboard blank of claim 10 wherein the top panel includes a longitudinally extending tear strip.

12. The paperboard blank of claim 11 wherein the bottom panel includes a longitudinally extending fold line.

13. The paperboard blank of claim 12 further including a perforation in the first side panel having an arcuate configuration and extending from a point adjacent to the adhesive panel to another spaced apart point adjacent to the adhesive panel.

14. The paperboard blank of claim 10 further comprising an adhesive panel first end flap adjacent to a top portion of the adhesive panel and an adhesive panel second end flap adjacent to a bottom portion of the adhesive panel.

15. The paperboard blank of claim 11 wherein the top panel includes a top panel first end flap adjacent to a top portion of the top panel and extending only partially across the width of the top panel and a top panel second end flap adjacent to a bottom portion of the top panel and extending only partially across the width of the top panel.

16. The paperboard blank of claim 15 wherein the bottom panel includes a bottom panel first end first flap and a bottom panel first end second flap adjacent to a top portion of the bottom panel and each extending only about one-half the width of the bottom panel and a bottom panel second end first flap and a bottom panel second end second flap adjacent to a bottom portion of the bottom panel and each extending only about one-half of the width of the bottom panel.

17. The paperboard blank of claim 10, further comprising a perforation in the first side panel adjacent to a fold line between the adhesive panel and the first side panel, the perforation line extending from a point adjacent to the adhesive panel to another spaced apart point adjacent to the adhesive panel.

* * * * *